US005297736A

United States Patent [19]

Vickery

[11] Patent Number: 5,297,736

[45] Date of Patent: Mar. 29, 1994

[54] FLOW TEST CHAMBER

[75] Inventor: Henry Vickery, Thonotosassa, Fla.

[73] Assignee: Vickery & Company, Thonotosassa, Fla.

[21] Appl. No.: 973,688

[22] Filed: Nov. 9, 1992

[51] Int. Cl.[5] ..... B05B 1/28

[52] U.S. Cl. ..... 239/122; 239/587.5

[58] Field of Search ..... 134/182; 239/124, 127, 239/104, 120-122, 587.5, 461, 499, 500

[56] References Cited

U.S. PATENT DOCUMENTS

| | | | |
|---|---|---|---|
| 2,675,012 | 4/1954 | Scales | 134/182 X |
| 3,904,431 | 9/1975 | Dinerman | 134/182 X |
| 4,235,373 | 11/1980 | Clark | 239/120 X |
| 4,530,465 | 7/1985 | Gauchet et al. | 239/127 |
| 5,028,002 | 7/1991 | Whitford | 239/120 X |

FOREIGN PATENT DOCUMENTS

| | | | |
|---|---|---|---|
| 1224004 | 4/1986 | U.S.S.R. | 239/121 |

*Primary Examiner*—David M. Mitchell
*Assistant Examiner*—Kevin P. Weldon
*Attorney, Agent, or Firm*—Janet E. Dillard

[57] ABSTRACT

A flow test chamber for diminishing and diverting the flow of a high pressure stream of water while testing a fire pump has a hollow chamber supported on a main support frame for receiving a high pressure stream of water forced by the fire pump through standard playpipes and nozzle tips retained in a stable position adjacent the hollow chamber on a playpipe support frame mounted on the main support frame. Screens suspended within the chamber diffuse and divert the flow of water as it enters the chamber with the water subsequently exiting through a discharge opening at a reduced rate of flow and diffused over a large area. An under carriage supports the main support frame for movement of the flow test chamber over the underlying surface in a generally horizontal orientation for easy positioning adjacent the fire pump to be tested.

17 Claims, 6 Drawing Sheets

FLOW TEST CHAMBER

TECHNICAL FIELD

This invention relates generally to apparatus for diverting and dissipating high pressure fluid flow, and more particularly to apparatus for diffusing and diminishing the flow of a high pressure stream of fluid when testing the flow capacity of a high pressure pump, such as a fire pump.

BACKGROUND OF THE INVENTION

In the construction of substantially all buildings, UL and/or FM approved fire pumps must be incorporated. The pumps provide water pressure for fire sprinklers, hydrants, or a standpipe system where the available source of water pressure is inadequate. All approved fire pumps are constructed and factory tested pursuant to the National Fire Protection Association ("NFPA") regulations. Most state and local fire and building regulatory agencies, as well as insurance underwriters, have adopted the NFPA regulations or code for testing fire pumps.

The NFPA code requires field testing of each new pump, and annual testing of existing pumps. Under supervision of the local building and fire authorities, the pumps are tested with full water flow to verify that the pump, the supply piping, and water source meet the design demand of the fire suppression system of the building.

Historically, although standard equipment is required for performing the test, there has been little standardization in the method of performing the test. Pursuant to the NFPA, the flow test is to be conducted using the underwriter's playpipe, 1 ⅛ inch brass nozzle tips, a pitot flow measuring gauge, a calibrated pressure gauge set, a hand-held tachometer, a digital voltmeter and a clip on ammeter, but the method of performing the test is not specified. Consequently, the particular manner in which the standardized equipment is used to perform the test is left up to the individual, thereby resulting in varied test length, accuracy, and total consumption of water with each test conducted.

Many of the new pump installation tests are conducted on dirt pad sites of new building construction. Such sites cannot handle the high pressure sprays and large volume of water runoff for the full duration of the flow test. Thus, the tests are often shorter in length than necessary to assure accurate results. Other sites do not have the physical space necessary to accommodate the full spray of water under high pressure without damage to surrounding property. In that event, the tests are often conducted at less than full pressure, resulting in inaccurate testing. Building sites and crowded city locations rarely afford sufficient spray areas without interrupting traffic for long periods or without potential harm to pedestrians and nearby property.

SUMMARY OF THE INVENTION

The flow test chamber of the present invention overcomes the foregoing and other problems associated with existing equipment for testing the flow of high pressure pumps, and in particular, fire pumps by receiving the full flow of a high pressure stream of water from at least one playpipe nozzle and diverting and dissipating the flow, thereby allowing for accurate, full force testing at almost any size location and under poor test site conditions, with reduced risk of damage to surrounding property.

A first embodiment of the invention includes at least one clamp mounted on a supporting rack for receiving and retaining at least one standard playpipe. The fluid stream from the playpipe is directed into an adjacent chamber wherein the flow is diverted and dissipated by passage through a series of screens acting as a baffle. The fluid stream finally contacts an angularly positioned wall and is directed at a greatly reduced flow velocity downwardly and outwardly through a discharge opening in the chamber.

The chamber and playpipe support rack are mounted on a main support frame, thereby providing the necessary stability to allow an operator to flow water from a no-load level to 150% of pump capacity utilizing from one to as many as eight or more playpipes simultaneously in a controlled, consistent and safe manner. Thus, the overall time period required to achieve accurate test results is reduced, along with a reduction in the potential for damage to bystanders and surrounding property.

In a second embodiment of the invention the flow test chamber has a generally rectangular shape and has suspended therein a series of varying mesh size screens functioning as baffles to diffuse and divert the flow of water. Instead of a discharge opening in one side of the chamber, the chamber has no bottom wall, thereby allowing the water to flow downwardly upon contacting the series of screens.

In a third embodiment of the invention, the chamber has a generally rectangular shape with a discharge opening parallel to and in line with the inlet through which the full pressure flow is received in the chamber from the playpipes. A series of screens are suspended between the inlet and discharge opening for diverting and diminishing the flow to a safe level. The flow test chamber of the present invention utilizes existing standardized test equipment. Therefore, existing pumps, as well as new installations, can be accurately and more safely tested in a reduced overall time, resulting in substantial savings of water and reduced risks of harm to bystanders, surrounding property, and the person conducting the test.

The main support frame of the flow chamber is equipped with an undercarriage and a trailer hitch to allow easy transportation from one test site to the next, and convenient positioning adjacent the pump to be tested.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
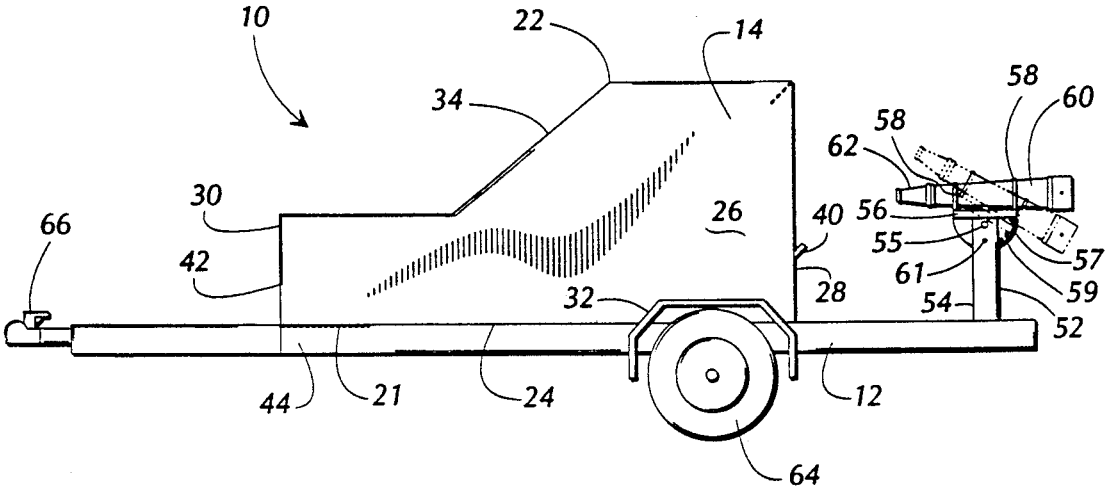
FIG. 1 is a side view of a flow test chamber incorporating a first embodiment of the present invention.
Figure 4:
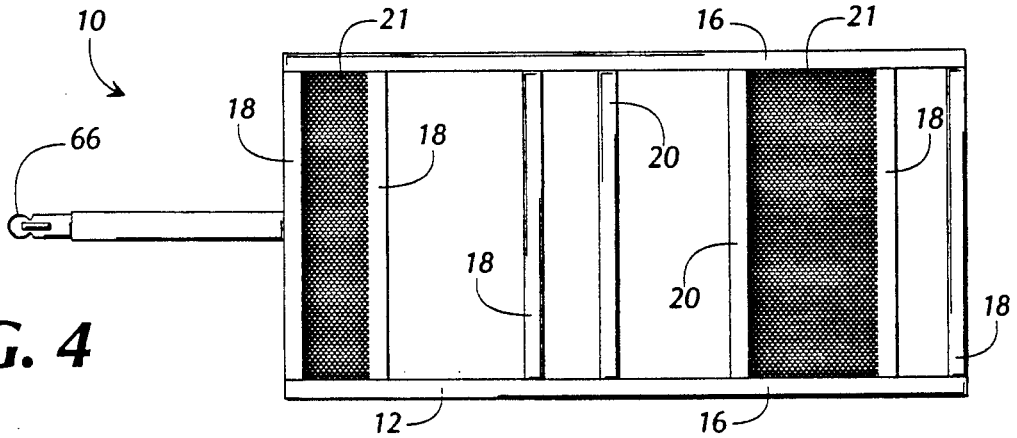
FIG. 4 is a top view of a main support frame of the flow test chamber of FIG. 1.

Referring now to the Drawings and more particularly to FIGS. 1 and 4, there is shown a flow test chamber 10 incorporating a first embodiment of the present invention. The flow test chamber 10 includes a main support frame 12 supporting a hollow chamber 14 thereon. Although the frame 12 may be fabricated from any number of sufficiently sturdy materials, in the preferred embodiment longitudinal support members 16 constructed of 2-inch by 4-inch steel tubing are connected by transversely extending spaced apart cross-members 18 fabricated from 4-inch channel iron and cross-members 20 fabricated from 6-inch channel iron. The cross-members 18 and 20 are positioned for optimal support of the hollow chamber 14. Although the main support frame may be open between the spaced apart cross-members 18, in the preferred embodiment of the invention, a wire mesh flooring 21 is attached to the longitudinal support members 16 and the cross-members 18.

The hollow chamber 14 has a top wall 22, a bottom wall 24, first and second sidewalls 26, a third sidewall 28 and a fourth sidewall 30. The bottom wall 24 has an angled portion 32, thereby allowing the bottom wall 24 to be fixedly attached to the support frame 12 such that the bottom wall 24 nearest the third sidewall 28 is attached above and supported by cross-members 20, and extends in a generally horizontal orientation at an elevation slightly above the bottom wall 24 nearest the fourth sidewall 30.

The top wall 22 has an angled section 34 substantially larger than the angled section 32 of the bottom wall but in substantially adjacent position to the angle section 32 of the bottom wall 24. The third sidewall 28 has an inlet opening 36 therein for receiving a high pressure stream of fluid into the hollow chamber 14. An upper flange 38 and lower flange 40 attached to the third sidewall 28 facilitate the flow of water into the hollow chamber 14 and reduce potential back-splash of water through the inlet 36.

A discharge opening 42 in the fourth sidewall 30 allows water to exit the hollow chamber 14 after the flow has been dissipated. A similar outlet 44 in the bottom wall 24 adjacent the fourth sidewall 30 is covered with a wire mesh 46 to allow additional escape of water from the chamber upon dissipation of the rate of flow. At least two screens 48 extend in a generally vertical orientation between and are fixedly attached to the top wall 22 and bottom wall 24 at spaced apart intervals. An additional screen 50 is attached to the angled portion 34 of the top wall 22 such that screens 48 and 50 function as baffles to dissipate and diffuse the high pressure stream of water as it enters the hollow chamber 14.

Figure 5:
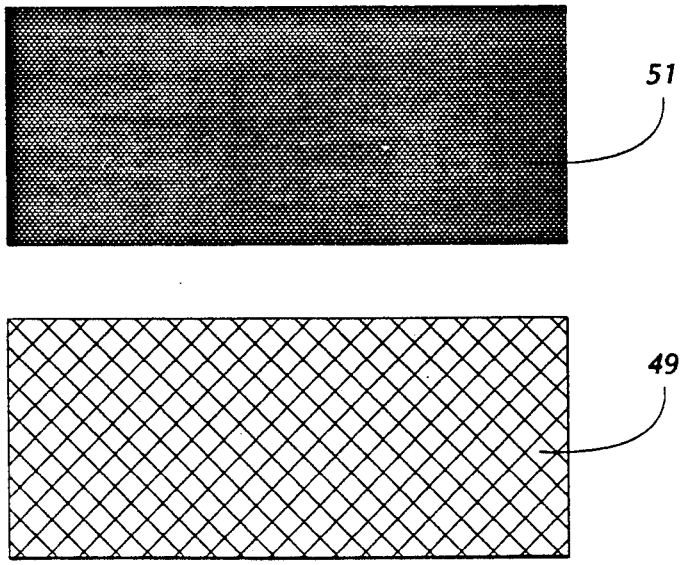
FIG. 5 is a front view of the screens suspended within the chamber of FIG. 1.

Referring now to FIG. 5, the screens 48 and 50 are of varying mesh sizes from large mesh 49 to small mesh 51, and are positioned such that the openings in each screen are offset from the openings in adjacent screens. Although the screens 48 and 50 may be arranged in any mesh size configuration, in the preferred embodiment of the invention, the first screen 48 contacted by the stream of water is of a large mesh size 49, followed by a smaller mesh size 51. After contacting the screens, the diffused water passes through discharge opening 42 and outlet 44 at a greatly reduced rate of flow, thereby alleviating potential risk of injury to pedestrians, bystanders, and surrounding property.

Figure 2:
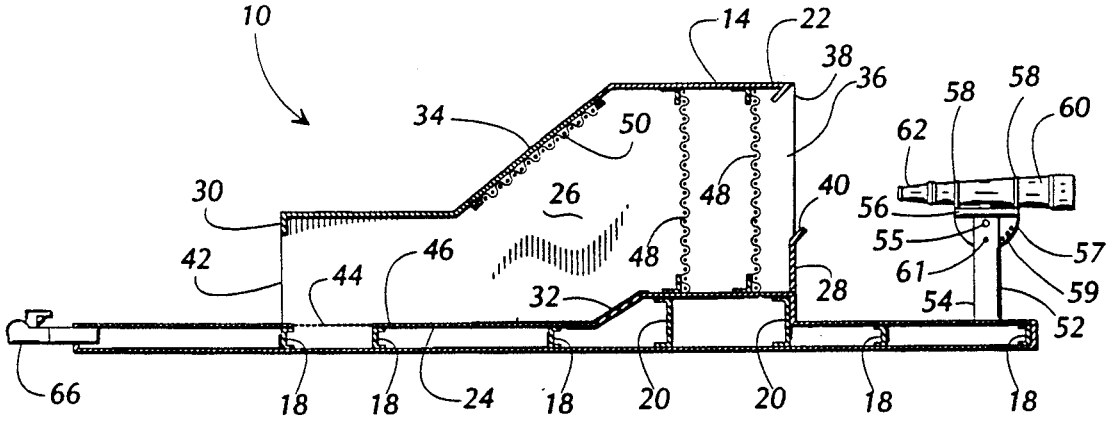
FIG. 2 is a section view of FIG. 1.
Figure 3:
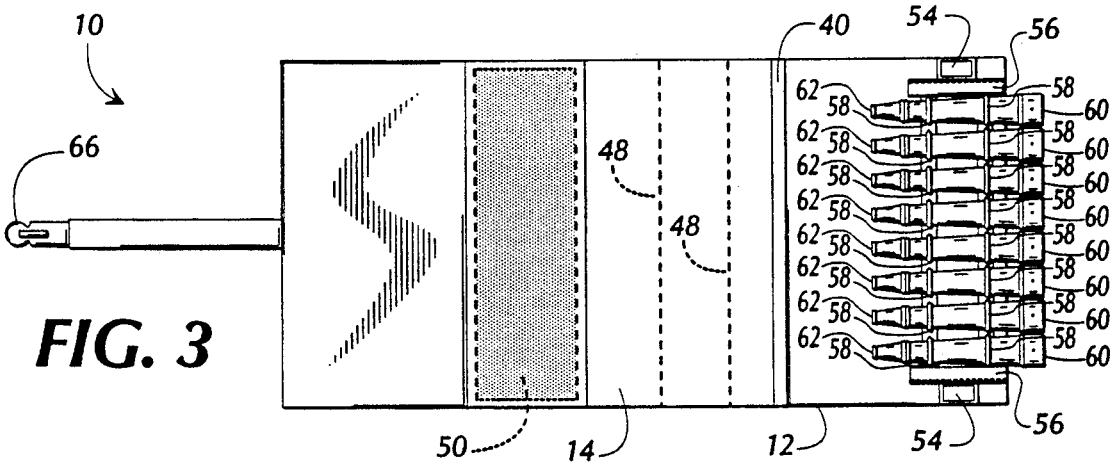
FIG. 3 is a top view of the flow test chamber FIG. 1 with screens suspended in the hollow chamber shown in phantom.

Referring now to FIGS. 1, 2 and 3, fixedly attached to the support frame 12 and extending in a generally vertical orientation adjacent to and a predetermined distance from the third sidewall 28 of the chamber 14 is a playpipe support frame 52. Cross-members 18 of the main support frame 12 are positioned for optimal support of the playpipe support frame 52.

Attached at pivotal attachment point 55 and pivotally supported for adjustable positioning between two vertically extending support arms 54 of the support frame 52 is a playpipe retaining rack 56. Mounted to the playpipe retaining rack 56 at spaced apart intervals are clamps 58 for receiving and retaining playpipes 60 in a fixed position on the playpipe retaining rack 56. Attached to and extending downwardly from the playpipe retaining rack 56 is a pivot plate 57. Spaced apart openings 59 in the pivot plate 57 are placed in alignment with a retaining pin 61 retractably mounted within the support arm 54 for securing the playpipe retaining rack 56 in any of a number of angular positions with respect to the inlet opening 36 in the third sidewall 28, as shown in phantom in FIG. 1. Thus, the spray from the playpipes may be tested at any one of a number of angles.

Standard playpipes required by NFPA regulations are 2 ½ inches by 1 ¾ inches for measurement of water flow under varying pressure to allow calibrated, repeatable measurement of the flow. For measurement of smaller flows, a 1 ¾ inch by 1 ⅛ inch brass tip nozzle 62 is fitted to the end of the standard playpipe 60. Although in the preferred embodiment of the invention the playpipe rack is fitted with eight playpipe clamps 58, the rack 56 may have any number of clamps 58 without departing from the spirit of the invention. Furthermore, as few as one playpipe or as many playpipes as the maximum number of clamps 58 contained on the rack 56 may be retained in the clamps 58 for flow testing of the pump or pumps to which the playpipes are connected through standard fire hoses.

Once the playpipes 60 are clamped into position on the playpipe rack 56, the pump being tested is actuated and a high pressure stream of water forced through the playpipe 60 into the inlet 36 in the third sidewall 28 of the hollow chamber 14. Appropriate building or fire authorities, through use of the required hand-held pitot, calibrated gauge set, hand-held tachometer, digital voltmeter and clip-on ammeter, test the supply and discharge pressure at the inlet and outlet of the pump. The arrangement and stability of the playpipe rack allows for accurate testing of the spray from as few as one or from many playpipes 60 simultaneously with the required equipment, thereby reducing the amount of time required to setup and test the flow from each playpipe individually.

Referring again to FIG. 1, an undercarriage 64 supports the main support frame 12 in a generally horizontal orientation for movement over the underlying surface during transportation and positioning of the flow test chamber 10 adjacent the fire pump to be tested. To facilitate transportation of the flow test chamber 10 a trailer hitch 66 is attached to the main support frame 12 adjacent to the fourth sidewall 30 such that the end of the support frame 12 on which the playpipe support frame 52 is mounted may be easily positioned adjacent the fire pump.

Figure 6:
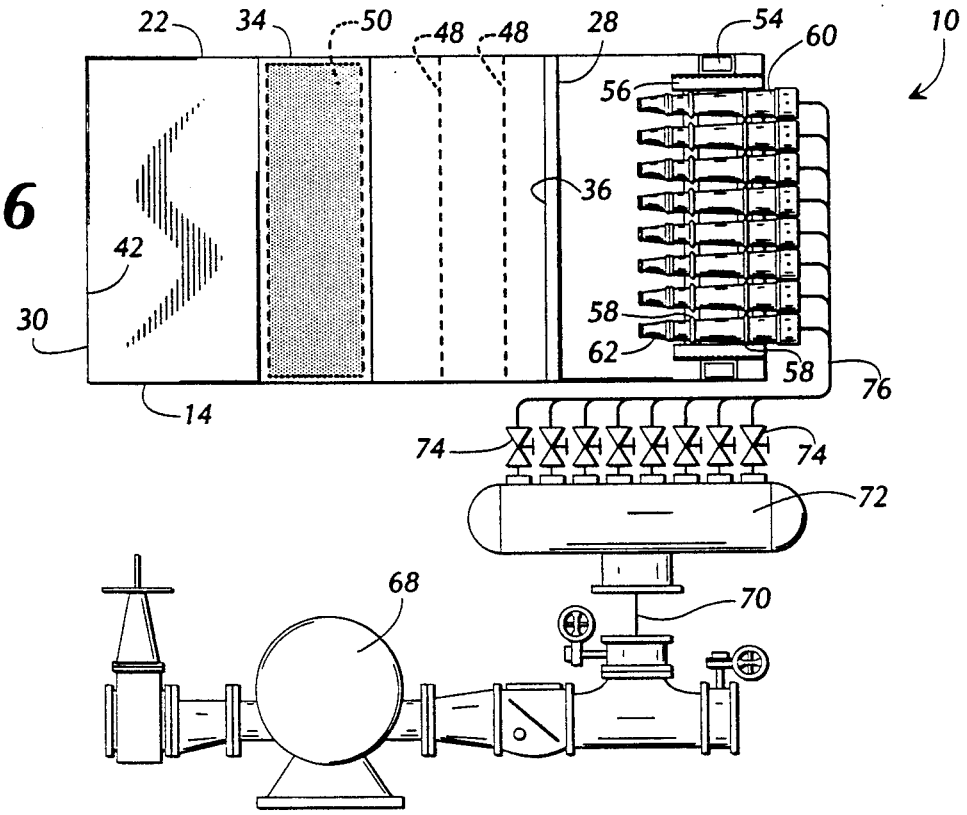
FIG. 6 is a top view illustrating the flow of water from a pump through the flow test chamber of FIG. 1.

Referring now to FIG. 6, water from a water source is received into the fire pump 68 and is forced under pressure through a test header supply 70 to a pump test header 72 equipped with a plurality of 2.5 inch test valves 74. Each 2.5 inch test valve will produce between zero and 500 gallons per minute fluid flow. The test valves 74 are connected through 2.5 inch UL rated fire hoses 76 to the playpipes 60. The water is then forced through the playpipes 60 and attached nozzle tips 62 retained by the clamps 58 in a stable position on the playpipe retaining rack 56 and into the hollow chamber 14 through the inlet 36 in the third sidewall 28. Testing of the flow is conducted between the nozzle tips 62 and the inlet 36.

Upon entering the hollow chamber 14, the high pressure stream of water contacts the first screen 48 which diffuses the directional flow and dissipates the rate of flow of the stream of water. The water next contacts the adjacent screen baffle 48 and is further diffused and dissipated before contacting the screen 50 mounted on the angled section 34 of the top wall 22 of the hollow chamber 14 for still further diffusion and dissipation of the fluid stream. The water is finally discharged through the discharge opening 42 in the fourth sidewall 30 and through the wire mesh 46 covering the outlet 44 in the bottom wall 24 of the hollow chamber 14.

Although the flow test chamber 10 incorporating a first embodiment of the present invention is shown having two vertical screens 48 and eight clamps 58 for receiving and retaining playpipes 60 therein, any number of screens or clamps may be incorporated without departing from the spirit of the invention.

Figure 7:
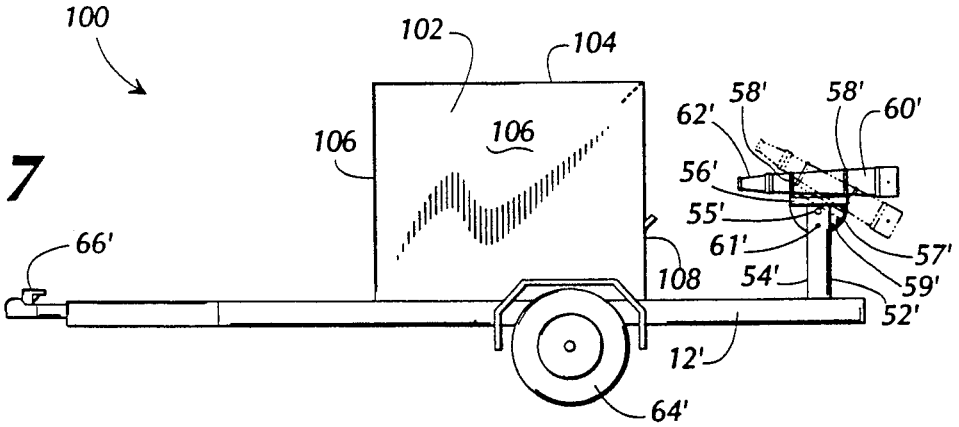
FIG. 7 is a side view of a flow test chamber incorporating a second embodiment of the present invention.
Figure 8:
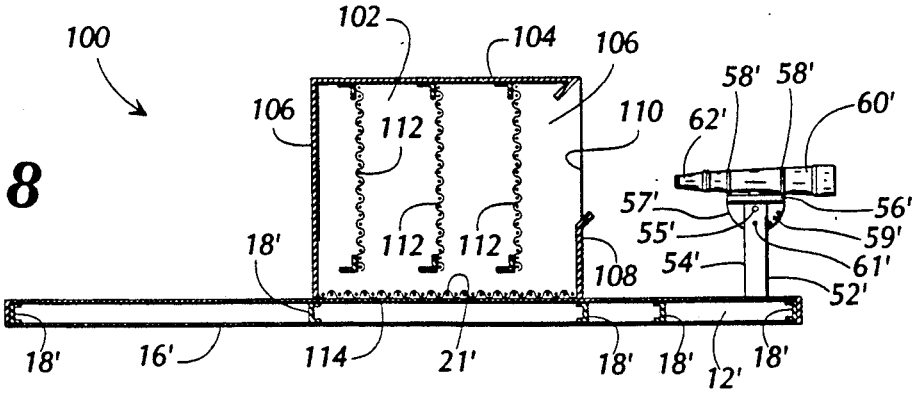
FIG. 8 is a section view of the flow test chamber of FIG. 7.

Referring now to FIGS. 7 and 8, there is shown a flow test chamber 100 incorporating a second embodiment of the present invention. Many of the elements of the flow test chamber 100 are similar to those of the flow test chamber 10 of FIG. 1 and will be given the same reference numerals with the elements of the flow test chamber 100 being differentiated by a prime ''''' designation. The flow test chamber 100 differs from the flow test chamber 10 with respect to the configuration of the hollow chamber 102, which has a substantially rectangular shape, with the length of the rectangle extending in a generally vertical orientation. Hollow chamber 102 has a top wall 104, first, second and third sidewalls 106 and a fourth sidewall 108.

The high pressure stream of water exits the playpipes 60' through the nozzle tips 62' and enters the hollow chamber 102 through an inlet opening 110 in the fourth sidewall 108. Screens 112 attached to the top wall 104 and the first and third sidewalls 106 extend at spaced apart intervals parallel to the inlet opening 110 for blocking the directional flow of the high pressure stream of water as it enters the hollow chamber 102. As the stream contacts the first screen 112, the screen acts as a baffle to diffuse and dissipate the flow rate of the stream. Upon contacting succeeding screens 112, the flow velocity of the stream of water is further diminished. The water flows at a greatly reduced rate out of the hollow chamber 102 through a discharge opening 114 defined by longitudinal support members 16' and transversely extending cross-members 18' of the main support frame 12. Thus, the water enters the chamber in a generally horizontal orientation and exits in a generally vertical orientation at a reduced rate of flow and over a widely diffused area.

Figure 10:
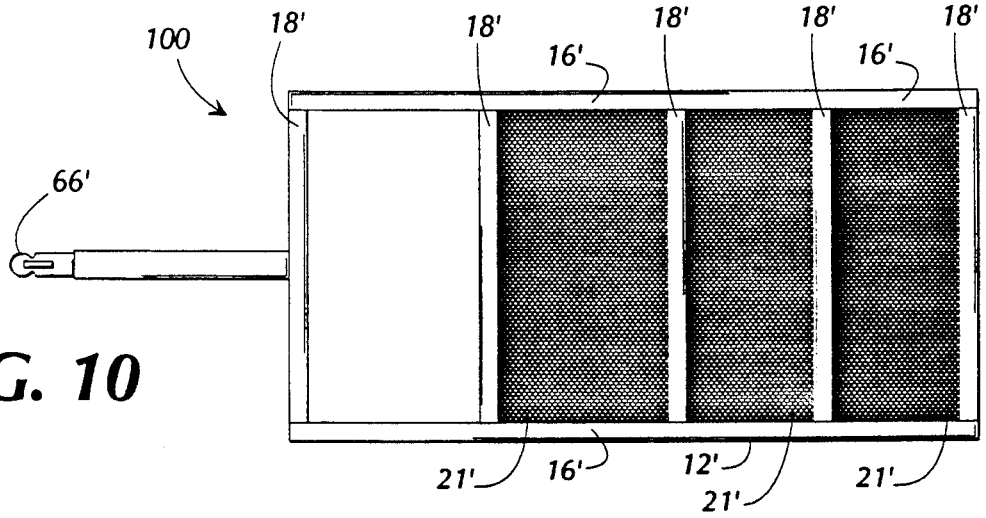
FIG. 10 is a top view of a main support frame of the flow test chamber of FIG. 7.

Referring now to FIGS. 8 and 10, the longitudinal support members 16' of the main support frame 12' are connected by the transversely extending cross-members 18'. In the preferred embodiment of the invention, the longitudinal support members 16' are fabricated from 2 inch by 4 inch steel tubing, and the cross-members 18' fabricated from 4 inch channel iron, although any number of commercially available materials may be used. The cross-members 18' are positioned to provide optimal support for the hollow chamber 102 and a playpipe support frame 52'. In the preferred embodiment of the invention, a wire mesh flooring 21' is attached to the longitudinal support members 16' and the cross-members 18'.

Figure 9:
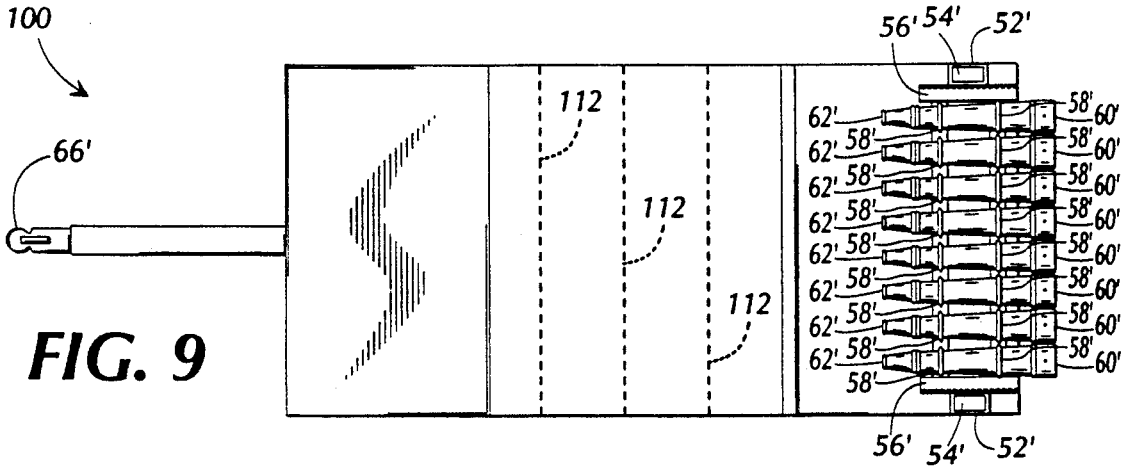
FIG. 9 is a top view of the flow test chamber of FIG. 7 with screens suspended in the hollow chamber shown in phantom.

Referring now to FIG. 9, the playpipe retaining rack 56' pivotally suspended between vertically extending support arms 54' of the playpipe support frame 52' is shown, for purposes of illustration, fitted with eight playpipe clamps 58' for receiving from one to eight playpipes 60' therein, although any number of clamps may be fixed to the playpipe retaining rack 56 without departing from the scope of the invention. Likewise, the hollow chamber 102 of the flow test chamber 100 is shown having three screens 112 suspended therein, although any number of screens may be used without departing from the scope of the invention.

Figure 11:
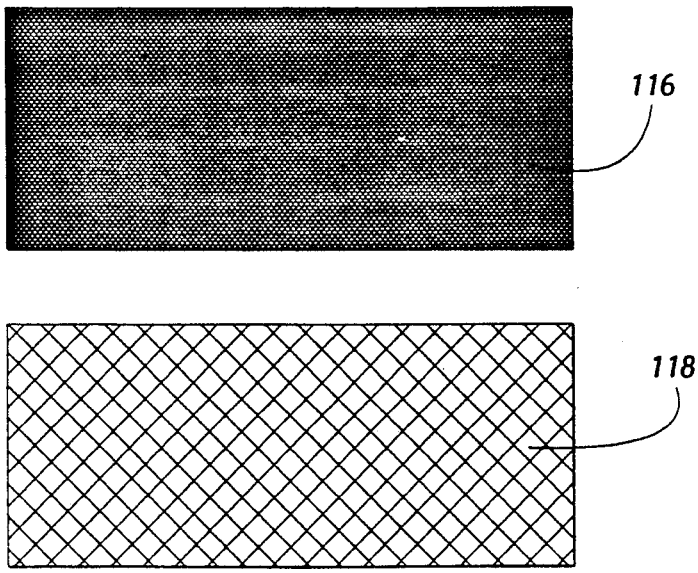
FIG. 11 is a front view of screens suspended within the flow test chamber of FIG. 7.

Referring now to FIGS. 8, 9, and 11, the screens 112 suspended within the hollow chamber 102 are of varying mesh sizes from small mesh 116 to large mesh 118. In the preferred embodiment of the invention, the screens are arranged within the hollow chamber 102 in order of mesh size beginning with the large mesh 118 followed by the small mesh 116, in turn followed by large mesh size 118, although any arrangement of mesh sizes may be incorporated without departing from the scope of the invention.

Figure 12:
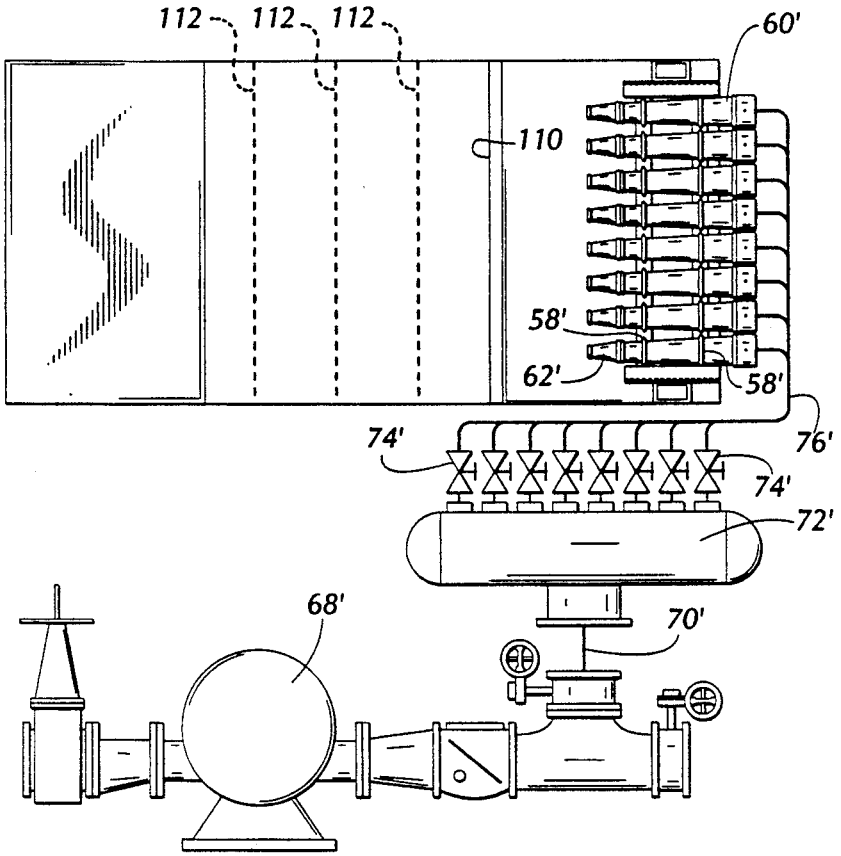
FIG. 12 is a top view illustrating the flow of water from a pump through the flow test chamber of FIG. 7.

Referring now to FIGS. 8 and 12, when a fire pump 68' is actuated for testing, water from a water source enters the fire pump 68' and is forced under pressure through a test header supply 70' to a pump test header 72' equipped with 2.5 inch test valves 74'. The test valves 74' are connected through fire hoses 76' to the playpipes 60' retained within the clamps 58' mounted on the playpipe retaining rack 56'. The water is forced through the playpipes 60' and from the attached nozzle tips 62' through the inlet opening 110 of the hollow chamber 102, where it contacts the first screen 112 and is diffused and dissipated before contacting the successive screens 112 for further diminishing the flow velocity. The water then flows downwardly through the discharge opening 114 at a greatly reduced rate of flow and diffused over a large area, thereby reducing risks of potential harm to surrounding individuals and property.

Figure 13:
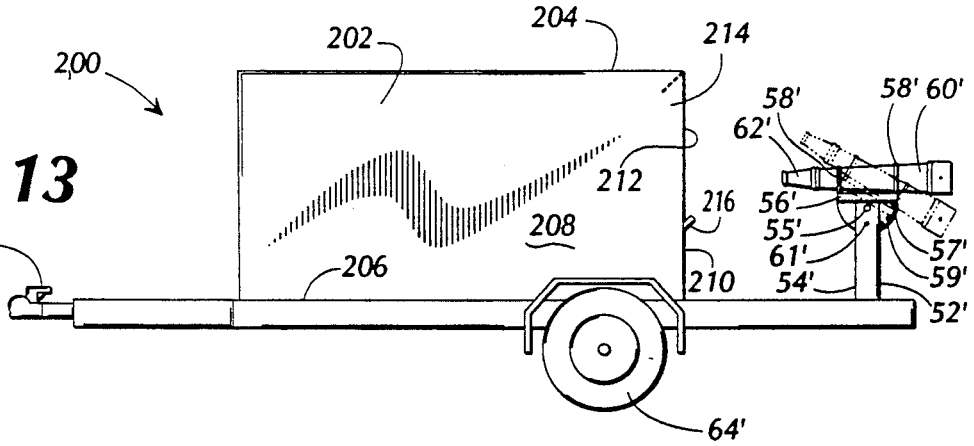
FIG. 13 is a side view of a flow test chamber incorporating a third embodiment of the present invention.
Figure 14:
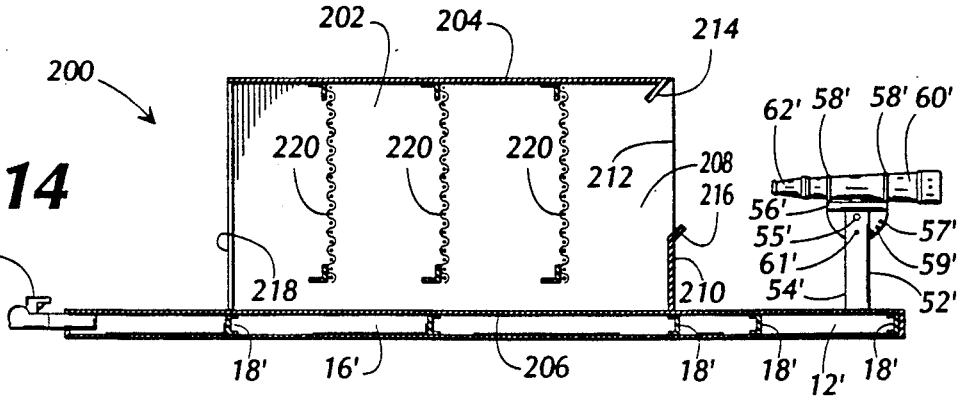
FIG. 14 is a section view of the flow test chamber of FIG. 13.
Figure 15:
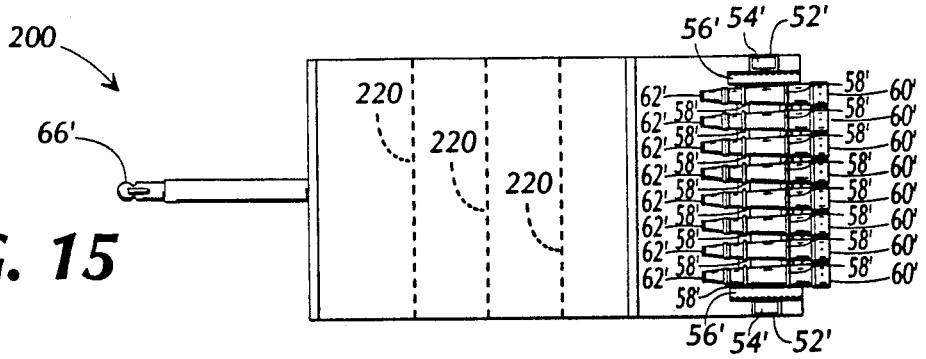
FIG. 15 is a top view of the flow test chamber of FIG. 13 with screens suspended in the hollow chamber shown in phantom.

Referring now to FIGS. 13, 14 and 15, there is shown a flow test chamber 200 incorporating a third embodiment of the present invention. Many of the elements of the flow test chamber 200 are similar to those of the flow test chamber 10 of FIG. 1 and will be given the same reference numerals with the elements of the flow test chamber 200 being differentiated by a prime ''''' designation.

The hollow chamber 202 of the flow test chamber 200 differs from the hollow chamber 14 of the flow test chamber 10 in that the hollow chamber 202 has a substantially rectangular configuration with the length of the rectangle extending in a generally horizontal orientation. The hollow chamber 202 has a top wall 204, a bottom wall 206, first and second sidewalls 208 and a third sidewall 210. The third sidewall 210 has an inlet opening 212 therein for receiving the high pressure stream of water from the playpipe 60' through the nozzle tips 62'. The third sidewall 210 has an upper flanges 214 and a lower flange 216 for facilitating the flow of the high pressure stream of water into the hollow chamber 202 and reducing potential back-splash from the chamber. The side of the chamber opposite the third sidewall 210 is open such that a discharge opening 218 is defined by unattached edges of the top wall 204, the bottom wall 206, and the first and second side walls 208.

Figure 16:
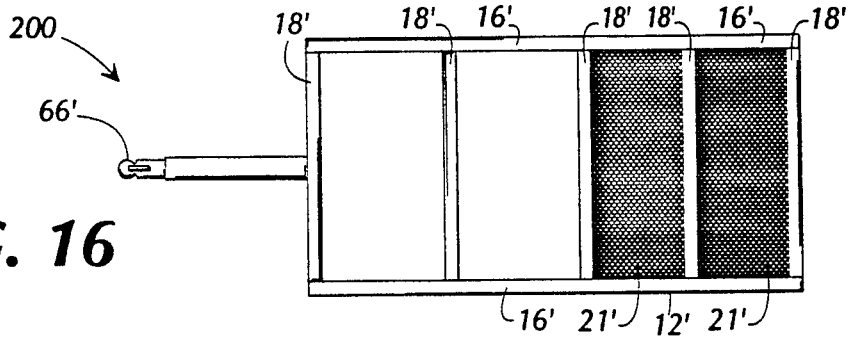
FIG. 16 is a top view of a main support frame of the flow test chamber of FIG. 13.

Referring now to FIGS. 14 and 16, the hollow chamber 202 is supported on a main support frame 12' having longitudinally extending support members 16' connected by transversely extending cross-members 18'. The longitudinally extending support members 16' are preferably fabricated from 2-inch by 4-inch steel tubing, with the cross-members 18' fabricated from 4-inch channel iron, although any of a number of commercially available materials may be used. The transversely extending cross-members 16' are positioned for optimal support of the playpipe support frame 52' and the hollow chamber 202. In the preferred embodiment of the invention, a wire mesh flooring 21' is attached to the longitudinal support members 16' and the cross-members 18'.

Figure 17:
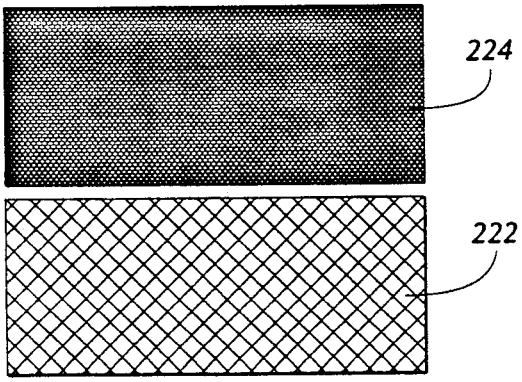
FIG. 17 is a front view of the screens suspended within the flow test chamber of FIG. 13.

Referring now to FIGS. 14, 15 and 17, suspended within the hollow chamber 202, attached to the top wall and the bottom wall, and extending from the first sidewall to the second sidewall are screens 220 of varying mesh sizes from a large mesh size 222 to a small mesh size 224. Although the screens 220 may be positioned in any mesh size order, in the preferred embodiment of the invention the screens are positioned such that the high pressure stream of water first contacts the larger mesh 222, then the smaller mesh 224, and back to the larger mesh 222 to increasingly dissipate and diffuse the flow of water upon contact with the successive screens. Thus, as the water exits the hollow chamber 202 the flow has been greatly dissipated and diffused to cover a larger area at a greatly reduced rate, thereby reducing risk of potential injury to bystanders and surrounding property. Although the flow test chamber 200 is shown incorporating three screens 220 and eight clamps 58' attached to the playpipe rack 56' for receiving from one to eight playpipes 60' therein, it is understood that any number of screens and clamps may be used without departing from the scope of the invention.

Figure 18:
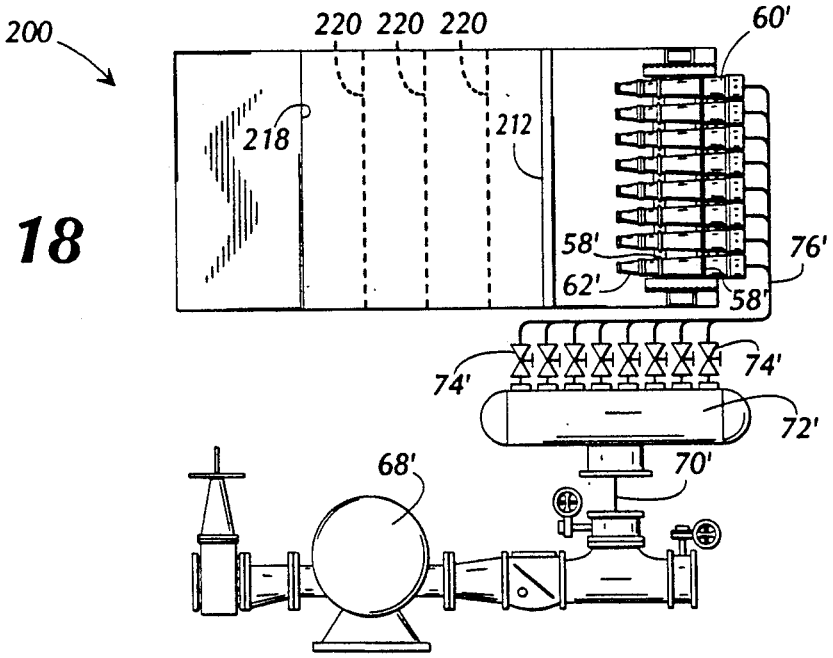
FIG. 18 is a top view illustrating the flow of water from a pump through the flow test chamber of FIG. 13.

Referring now to FIGS. 14 and 18, upon actuation of a fire pump 68' for testing, water from a water source enters the fire pump 68' and is forced under pressure through a test header supply 70' to a pump test header 72' equipped with 2.5 inch test valves 74'. The test valves 74' are connected through fire hoses 76' to the playpipes 60' mounted within the clamps 58' attached to the playpipe retaining rack 56'. The water is forced through the playpipes 60' and the nozzle tips 62' through the inlet opening 212 of the hollow chamber 202 and contacts the first screen 220 where upon the stream of water is diffused and dissipated before contacting the successive screens 112 for further diffusion and dissipation of the flow. The water then flows outwardly through the discharge opening 218 at a greatly reduced rate of flow and diffused over a larger area, thereby reducing risks of potential harm to surrounding individuals and property.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the spirit of the invention.

I claim:

1. Apparatus for receiving and diverting a high pressure stream of fluid comprising:

a hollow chamber positionable for receiving the stream of fluid therein;

an inlet in the chamber for entry of the fluid stream into the chamber;

at least one screen positionally aligned within the chamber perpendicular to the flow of fluid stream for diminishing the rate of flow of the fluid stream; and a discharge opening in the chamber for discharge of the diminished fluid stream from the chamber.

2. The fluid flow diverting apparatus of claim 1, further comprising at least one screen positionally aligned at an angle with respect to the flow of fluid stream for diminishing the rate of flow of the fluid stream.

3. Apparatus for receiving and diverting a high pressure stream of fluid forced through an outlet comprising:

a hollow chamber positionable adjacent to the outlet for receiving the stream of fluid including an angled wall for diverting the directional flow and diminishing the rate of flow of the stream;

an inlet in the chamber for entry of the fluid stream into the chamber; and a discharge opening in the chamber offset from the inlet for discharge of the diverted fluid from the hollow chamber.

4. The fluid flow diverting apparatus of claim 3, further comprising baffle means positioned within the interior of the chamber for receiving the impact from the stream of fluid and diminishing the rate of flow of the stream.

5. The fluid flow diverting apparatus of claim 3, wherein the angled wall has a top section extending at a predetermined angle in a direction generally downwardly and outwardly away from the inlet, a middle section extending from the top section in a generally horizontal direction away from the top section, and a bottom section extending in a generally vertical direction downwardly from the middle section.

6. The fluid flow diverting apparatus of claim 5, further comprising baffle means attached to the top section of the angled wall for further diminishing the rate of flow and diverting the directional flow of the fluid stream.

7. Apparatus for controlling the flow of a pressurized stream of fluid forced by a pump through an outlet during testing of the pump capacity comprising:

an outlet support frame for supporting at least one outlet;

a hollow chamber including an inlet wall and a bottom wall adjacent to the outlet support frame for receiving the stream of fluid therein;

an inlet opening in the inlet wall of the chamber for entry of the fluid stream into the chamber;

a discharge opening in the bottom wall of the chamber for diverting the directional flow of the fluid in a generally downwardly direction; and baffle means attached to the interior of the chamber a predetermined distance from and in alignment with the inlet opening in the chamber for deflecting and slowing the fluid flow as it enters the chamber.

8. The fluid flow controlling apparatus of claim 7, wherein the baffle means further comprises at least one screen extending opposite the inlet and in perpendicular alignment with the flow of fluid for receiving the impact from the stream of fluid and diminishing the rate of flow of the stream.

9. Apparatus for controlling the rate and directional flow of a pressurized stream of water forced through an outlet under pressure generated by a pump when testing the pump capacity comprising;

an outlet support frame for supporting at least one outlet;

clamp means attached to the outlet support frame for retaining the outlet in a fixed position for controlling the directional flow of the stream;

a hollow chamber positioned adjacent to the outlet support frame for receiving the stream of water therein and having first, second, third, and fourth side walls, and top and bottom walls;

an inlet opening in the first side wall of the chamber for entry of the stream of water into the chamber;

a series of screens of varying mesh sizes attached to the interior of the chamber for diverting the directional flow and diminishing the rate of flow of the water as it passes through the chamber;

a discharge opening for exiting the diverted and diminished stream of water from the chamber;

a main support frame attached to and supporting the chamber and the outlet support frame; and undercarriage means for movement and positioning of the chamber adjacent the outlet.

10. Apparatus for controlling the rate and directional flow of a pressurized stream of water forced through an outlet under pressure generated by a pump when testing the pump capacity comprising;

an outlet support frame for supporting at least one outlet;

clamp means attached to the outlet support frame for retaining the outlet in a fixed position for controlling the directional flow of the stream;

a hollow chamber positioned adjacent to the outlet support frame for receiving the stream of water therein, the chamber having an angled wall extending at a predetermined angle in a generally downwardly and outwardly direction for diverting the directional flow of the stream of water and diminishing the rate of flow of the stream;

an inlet opening in the chamber for entry of the stream of water into the chamber;

baffle means attached to the interior of the chamber for diminishing the rate of flow of the water as it passes through the chamber;

a discharge opening for exiting the diverted and diminished stream of water from the chamber;

a main support frame attached to and supporting the chamber and the outlet support frame; and undercarriage means for movement and positioning of the chamber adjacent the outlet.

11. Apparatus for controlling the rate and directional flow of a pressurized stream of water forced through an outlet under pressure generated by a pump when testing the pump capacity comprising;

an outlet support frame for supporting at least one outlet;

clamp means attached to the outlet support frame for retaining the outlet in a fixed position for controlling the directional flow of the stream;

a hollow chamber positioned adjacent to the outlet support frame for receiving the stream of water therein and having an angled wall;

an inlet opening in the chamber for entry of the stream of water into the chamber;

first baffle means attached to the interior of the chamber for diverting the directional flow and diminishing the rate of flow of the water as it passes through the chamber;

second baffle means attached to the angled wall of the chamber for further diminishing the rate of flow of the stream of water;

a discharge opening for exiting the diverted and diminished stream of water from the chamber;

a main support frame attached to and supporting the chamber and the outlet support frame; and undercarriage means for movement and positioning of the chamber adjacent the outlet.

12. Apparatus for controlling the rate and directional flow of a pressurized stream of water forced through an outlet under pressure generated by a pump when testing the pump capacity comprising;

an outlet support frame for supporting at least one outlet;

clamp means attached to the outlet support frame for retaining the outlet in a fixed position for controlling the directional flow of the stream;

a hollow chamber positioned adjacent to the outlet support frame for receiving the stream of water therein;

an inlet opening in the chamber for entry of the stream of water into the chamber;

baffle means attached to the interior of the chamber for diverting the directional flow and diminishing the rate of flow of the water as it passes through the chamber;

a discharge opening for exiting the diverted and diminished stream of water from the chamber;

a main support frame attached to and supporting the chamber and the outlet support frame;

undercarriage means for movement and positioning of the chamber adjacent the outlet; and hitch means for attachment to a vehicle for movement and positioning of the apparatus at remote sites.

13. Apparatus for receiving and diverting a high pressure stream of fluid for the purpose of testing the flow capacity of said stream of fluid comprising:

a hollow chamber positionable adjacent to the stream of fluid for receiving the stream therein;

an inlet in the chamber for entry of the fluid stream into the chamber;

at least one mesh screen positionally aligned within the chamber in the path of the fluid stream for diminishing the rate of flow of the fluid stream; and a discharge opening in the chamber for discharge of the diminished fluid stream from the chamber.

14. The fluid flow diverting apparatus of claim 3 further comprising multiple mesh screens of varying mesh sizes positionally aligned within the chamber for diminishing the rate of flow of the fluid stream.

15. The fluid flow diverting apparatus of claim 13 wherein the mesh screen is positionally aligned at an angle with respect to the flow of fluid stream for diminishing the rate of flow of the fluid stream.

16. The fluid flow diverting apparatus of claim 13 wherein the chamber includes an angled wall positioned in the path of the fluid stream for diverting the directional flow and diminishing the rate of flow of the stream.

17. An apparatus for receiving and diminishing a high pressure stream of fluid comprising:

a nozzle support frame for supporting at least one nozzle for emitting a stream of fluid and for supporting a playpipe and hose attached to the nozzle;

a hollow chamber positioned adjacent the nozzle support frame for receiving the stream of fluid therein;

an inlet opening in the chamber for entry of the stream of fluid into the chamber;

a series of screens of varying mesh sizes attached to the interior of the chamber for diminishing the rate of flow of fluid as it passes through the chamber;

a discharge opening in the chamber for exiting the diverted and diminished stream of water from the chamber;

a main support frame for supporting the chamber and the nozzle support frame;

undercarriage means mounted to the main support frame for movement and positioning of the apparatus; and hitch means for attachment to a vehicle for movement and positioning of the apparatus at remote sites.

* * * * *